US005510883A

United States Patent [19]

Kimura et al.

[11] Patent Number: 5,510,883

[45] Date of Patent: Apr. 23, 1996

[54] ELECTROPHOTOGRAPHIC SINGLE-COMPONENT DEVELOPING DEVICE

[75] Inventors: Tsutomu Kimura; Masaaki Fukuhara; Yasuhito Takahashi; Toru Isosu, all of Ebina, Japan

[73] Assignee: Fuji Xerox Co., Ltd., Tokyo, Japan

[21] Appl. No.: 386,598

[22] Filed: Feb. 10, 1995

Related U.S. Application Data

[63] Continuation of Ser. No. 87,327, Jul. 8, 1993, abandoned.

[30] Foreign Application Priority Data

Jul. 16, 1992 [JP] Japan ..... 4-189428

[51] Int. Cl.[6] ..... G03G 15/00

[52] U.S. Cl. ..... 355/245; 118/656; 355/260; 366/279

[58] Field of Search ..... 355/260, 245, 355/251, 253, 259; 222/DIG. 1; 118/657, 658, 656, 653; 366/154.1, 133, 135, 136, 157.1, 158.1, 158.3, 279, 224, 292, 293, 296, 297

[56] References Cited

U.S. PATENT DOCUMENTS

| | | | |
|---|---|---|---|
| 4,943,830 | 7/1990 | Sulenski | 355/245 |
| 4,960,069 | 10/1990 | Kaieda | 118/657 |
| 4,980,724 | 12/1990 | Tanaka . | |
| 4,999,676 | 3/1991 | Mouri | 355/246 |
| 5,012,285 | 4/1991 | Oka et al. | 355/245 |
| 5,049,941 | 9/1991 | Manno et al. | 355/260 |
| 5,139,176 | 8/1992 | Reindl et al. | 222/DIG. 1 X |
| 5,142,333 | 8/1992 | Verbeek et al. | 355/245 |
| 5,143,017 | 9/1992 | Haneda et al. | 118/658 |
| 5,189,474 | 2/1993 | Miya et al. | 355/245 |
| 5,235,389 | 8/1993 | Kikuchi et al. | 355/260 |
| 5,264,900 | 11/1993 | Momiyama et al. | 355/260 |
| 5,307,129 | 4/1994 | Miura et al. | 355/260 |

FOREIGN PATENT DOCUMENTS 3-168781 7/1991 Japan .

*Primary Examiner*—Matthew S. Smith
*Assistant Examiner*—Thu Dang
*Attorney, Agent, or Firm*—Oliff & Berridge

[57] ABSTRACT

An electrophotographic single-component developing device including a development roller; a toner storing portion provided in parallel relationship to an axis of the development roller, for storing a single-component toner; and a toner feeding unit provided in the toner storing portion, for feeding the single-component toner stored in the toner storing portion in a direction parallel to the axis of the development roller and supplying the single-component toner to the development roller. The toner feeding unit has a spiral agitator formed from a wire. Accordingly, the ability of toner feed along the development roller and the ability of toner supply to the development roller can be improved without deterioration of the toner.

9 Claims, 5 Drawing Sheets

ELECTROPHOTOGRAPHIC SINGLE-COMPONENT DEVELOPING DEVICE

This is a Continuation of application Ser. No. 08/087,327 filed Jul. 8, 1993, now abandoned.

BACKGROUND OF THE INVENTION

1. Field of the Invention

The present invention relates to an electrophotographic developing device for developing a latent image formed on a photosensitive drum with use of a toner as a developer, and more particularly to an electrophotographic single-component developing device including a toner storing portion for storing a single-component toner supplied from a toner container, and an agitator for feeding the toner from the toner container to the toner storing portion and supplying the toner from the toner storing portion to a development roller.

2. Description of the Related Art

FIGS. 9 and 10 show a prior art electrophotographic single-component developing device using a single-component toner as a developer. Referring to FIGS. 9 and 10, reference numeral 1 designates a housing of the developing device. There is defined in the housing 1 a toner storing portion 2 for storing a magnetic single-component toner TN. The toner storing portion 2 is connected to a toner supply passage 3 into which the toner TN is supplied from a toner hopper (not shown). Toner feeding means 4 for feeding the toner TN is provided in the toner storing portion 2 and the toner supply passage 3.

As shown in FIG. 11, the toner feeding means 4 comprises a rotating shaft 4*a*, a spiral blade 4*b* formed on the rotating shaft 4*a*, and a U-shaped agitator rod 4*c* consisting of a pair of vertical portions 4*c*1 connected to the rotating shaft 4*a* and a horizontal portion 4*c*2 extending between the vertical portions 4*c*1 in parallel relationship to the rotating shaft 4*a*. The spiral blade 4*b* is located in the toner supply passage 3, and the agitator rod 4*c* is located in the toner storing portion 2. The rotating shaft 4*a* of the toner feeding means 4 is rotated in a direction depicted by an arrow P in FIG. 9, and the toner TN supplied from the toner hopper to the toner supply passage 3 is accordingly fed into the toner storing portion 2 by the rotation of the spiral blade 4*b*. The agitator rod 4*c* has no ability to feed the toner TN in the toner storing portion 2 in the axial direction of the rotating shaft 4*a*. Therefore, the toner TN is stored into the whole of the toner storing portion 2 only by the ability of toner feed of the spiral blade 4*b*.

The toner TN stored in the toner storing portion 2 is supplied to a development roller 5 by the rotation of the agitator rod 4*c*. The toner TN supplied to the development roller 5 is magnetically attached to a development sleeve 6 rotating in a direction depicted by an arrow Q in FIG. 9. At this time, the rising amount (height) of a magnetic brush of the toner TN on the development sleeve 6 is restricted by a blade 7 to form a uniform thin layer on the development sleeve 6. Then, the toner TN in the form of the uniform thin layer on the development sleeve 6 is transferred to a photosensitive drum 8 rotating in a direction depicted by an arrow R. Thus, an electrostatic latent image formed on the photosensitive drum 8 is developed by the toner TN.

In the above developing device, the amount of the toner TN to be used for the development of an image having a normal image density is not so large. Accordingly, the toner TN is supplied into the whole of the toner storing portion 2, that is, over the development roller 5 only by the ability of toner feed of the spiral blade 4*b*.

However, in continuously developing an image having a high image density (e.g., 20% or more) such as a photograph image, the amount of the toner TN to be used becomes very large. Accordingly, the amount of the toner TN is supplied only by the ability of toner feed of the spiral blade 4*b* and becomes insufficient. That is, in continuously using a large amount of the toner TN, the conventional developing device is inferior in the ability of toner feed in a direction parallel to the axis of the development roller 5, thus causing a problem such that the toner TN cannot be sufficiently and uniformly supplied over the toner storing portion 2, i.e., over the development roller 5 to and thus outputs a partially lacking developed image.

Further, the conventional developing device has a structure such that the toner TN is not circulated in the toner storing portion 2. Accordingly, a part of the toner TN not consumed in developing an image having a normal image density is deteriorated in the toner storing portion 2. The deteriorated toner TN is gradually gathered at an end portion of the toner storing portion 2 in the feeding direction as time proceeds. The gathering of the deteriorated toner TN hinders uniform supply of the toner TN in the axial direction of the development roller 5, causing a reduction in quality of the developed image such that a uniform density of the toner image cannot be obtained even in developing an image having a normal image density.

As another conventional developing device using a two-component developer, there is disclosed in U.S. Pat. No. 4,980,724 a two-component developing device including a spiral blade with a paddle extending in an axial direction of an agitator, and there is also disclosed in Japanese Patent Laid-open Publication No. 3-168781 a two-component developing device including a spiral blade with an agitating blade extending in parallel to a rotating shaft and further including a spiral powder feeding groove. Each two-component developing device has realized a relatively high ability of feed of a toner or a two-component developer owing to the spiral blade or the combination of the spiral blade and the spiral powder feeding device as developer feeding means.

It is accordingly considered to apply the developer feeding means of the two-component developing device having the relatively high feed ability mentioned above to the toner feeding means of the single-component developing device mentioned above, so as to enhance the toner feed ability of the single-component developing device.

However, since each two-component developing device mentioned above uses a two-component developer, it is necessary to agitate a toner and a carrier. Therefore, the developer feeding means of each two-component developing device is set to have the ability of very strong agitation of the developer. For this reason, the application of the developer feeding means of each two-component developing device to the toner feeding means of the single-component developing device will cause vigorous agitation of the toner, so that the toner may be greatly deteriorated to reduce the image quality. Consequently, the developer feeding means of each two-component developing device cannot be applied to the toner feeding means of the single-component developing device.

SUMMARY OF THE INVENTION

It is accordingly an object of the present invention to provide an electrophotographic single-component developing device which can prevent the deterioration of a single-component toner stored in a toner storing portion.

It is another object of the present invention to provide an electrophotographic single-component developing device which can improve the ability of toner feed along a development roller.

It is a further object of the present invention to provide an electrophotographic single-component developing device which can improve the ability of toner supply to a development roller.

According to the a first aspect of the present invention, there is provided an electrophotographic single-component developing device comprising a development roller; toner storing means provided in parallel relationship to an axis of the development roller, for storing a single-component toner; and toner feeding means provided in the toner storing means, for feeding the single-component toner stored in the toner storing means in a direction parallel to the axis of the development roller and supplying the single-component toner to the development roller, the toner feeding means comprising a spiral agitator formed from a wire.

The spiral agitator formed from a wire is provided in the toner storing means along the development roller. Accordingly, the toner stored in the toner storing means is fed in a direction parallel to the axis of the development roller with less agitation, thereby improving the ability of toner feed along the development roller. Accordingly, a sufficient amount of the toner is supplied to the development roller uniformly in the axial direction thereof, so that even when a consumption of the toner becomes large as in continuously developing an image having a high image density, the insufficient development of the image can be reliably prevented to thereby obtain a high quality of the developed image.

According to a second aspect of the present invention, the toner storing means comprises a first circulation passage juxtaposed to the development roller so as to extend in parallel to the axis of the development roller and a second circulation passage juxtaposed to the first circulation passage so as to extend in parallel to the axis of the development roller, the first and second circulation passages communicating with each other at opposite ends thereof; and the spiral agitator comprises a first agitator provided in the first circulation passage and a second agitator provided in the second circulation passage, so as to circulate the single-component toner stored in the first and second circulation passages.

The unused toner stored in the toner storing means is circulated by the first and second agitators in the first and second circulation passages. Accordingly, the unused toner is prevented from hardening, and it can be maintained always in a good condition. As a result, a necessary and sufficient amount of the toner can be supplied to the development roller uniformly in the axial direction thereof, thereby further improving the quality of the developed image.

According to a third aspect of the present invention, there is provided the toner feeding means further comprising an accelerator rod mounted on the spiral agitator so as to extend in parallel to the axis of the development roller, for supplying the single-component toner to the development roller.

Owing to the provision of the accelerator rod to the spiral agitator, the amount of the toner to be supplied to the development roller can be increased to thereby improve the ability of toner supply to the development roller.

Other objects and features of the invention will be more fully understood from the following detailed description and appended claims when taken with the accompanying drawings.

DETAILED DESCRIPTION OF THE PREFERRED EMBODIMENTS

Figure 1:
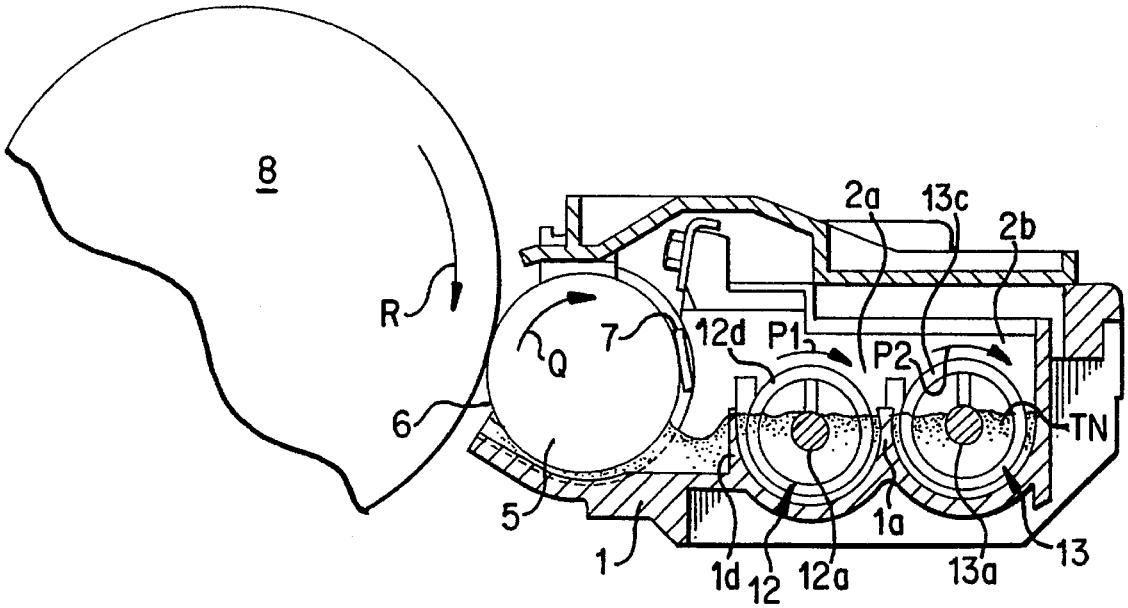
FIG. 1 is a schematic sectional view of an electrophotographic single-component developing device according to a first preferred embodiment of the present invention.

A first preferred embodiment of the present invention will now be described with reference to FIGS. 1 to 3, in which the same reference numerals as those shown in FIGS. 9 to 11 denote the same parts, and the detailed explanation thereof will be omitted herein.

Figure 2:
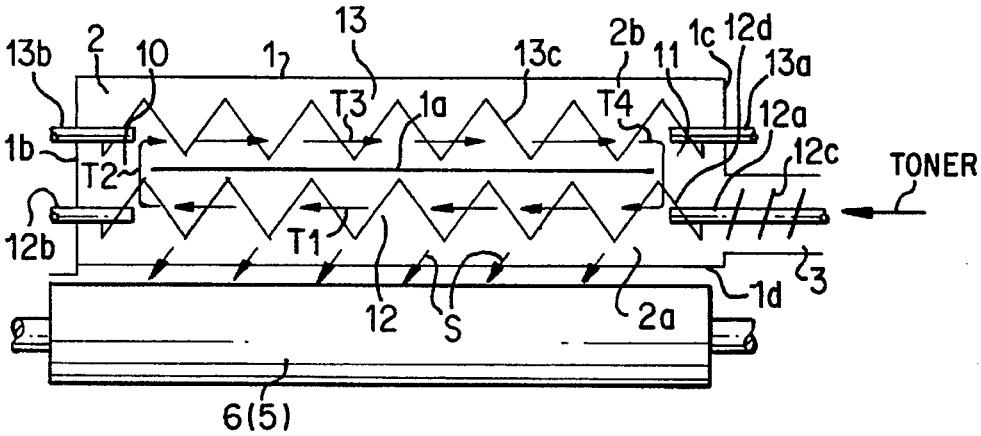
FIG. 2 is a schematic plan view of FIG. 1.
Figure 3:
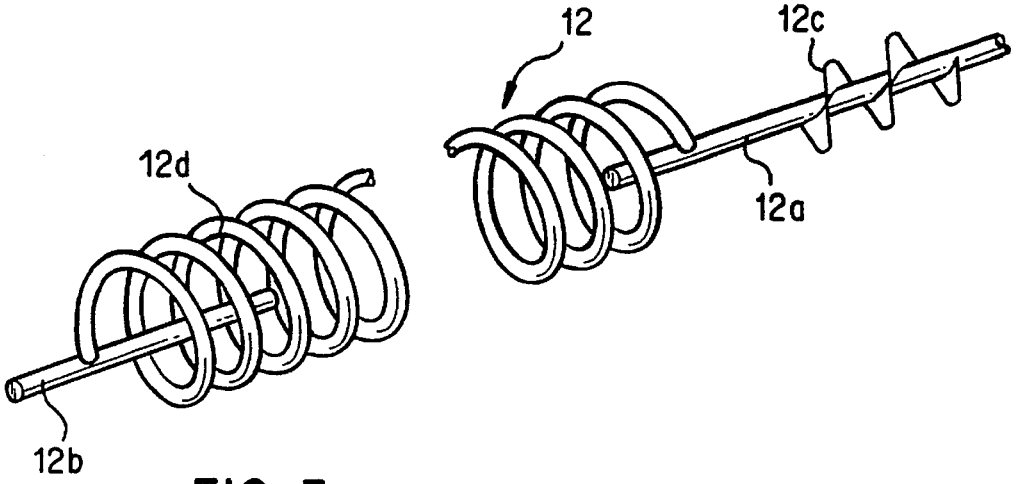
FIG. 3 is a perspective view of toner feeding means employed in the first preferred embodiment.

Referring to FIGS. 1 and 2, a toner storing portion 2 is provided in a housing 1 of an electrophotographic single-component developing device. The toner storing means 2 includes a first circulation passage 2*a* extending in parallel to the axis of a development roller 5 and a second circulation passage 2*b* extending in parallel to the first circulation passage 2*a*. The first circulation passage 2*a* is adapted to receive a toner TN from a toner supply passage 3. A partition wall 1*a* is provided between the first and second circulation passages 2*a* and 2*b*. As viewed in FIG. 2, one end of the partition wall 1*a* is opposed to a left side wall 1*b* of the housing 1 to define a left opening 10 therebetween, and the other end of the partition wall 1*a* is opposed to a right side wall 1*c* of the housing 1 to define a right opening 11 therebetween.

First and second feeding means 12 and 13 for feeding the toner TN in the toner storing portion 2 are provided in the first and second circulation passages 2*a* and 2*b*, respectively. As best shown in FIG. 3, the first feeding means 12 comprises a pair of right and left coaxial rotating shafts 12*a* and 12*b*, a spiral blade 12*c* formed on the right rotating shaft 12*a*, and a spiral agitator 12*d* having one end connected to the right rotating shaft 12*a* and the other end connected to the left rotating shaft 12*b*. The spiral agitator 12*d* is formed from a wire. The spiral blade 12*c* is located in the toner supply passage 3, and the spiral agitator 12*d* is located in the first circulation passage 2*a*.

The second feeding means 13 has substantially the same construction as that of the first feeding means 12 except that the spiral blade 12*c* is not provided. That is, the second feeding means 13 comprises a pair of right and left rotating shafts 13*a* and 13*b* and a spiral agitator 13*c* having one end connected to the right rotating shaft 13*a* and the other end connected to the left rotating shaft 13*b*. The spiral agitator 13*c* is formed of a wire, and it is located in the second circulation passage 2*b*. The direction of spirality of the spiral agitator 13*c* is reverse to that of the spiral agitator 12*d*.

When the first and second rotating shafts 12*a* and 12*b* of the first feeding means 12 are driven to rotate in a direction depicted by an arrow P1 in FIG. 1, the toner TN supplied from a toner hopper (not shown) to the toner supply passage 3 is fed to the first circulation passage 2*a* of the toner storing portion 2 by means of the spiral blade 12*c*. The toner TN fed into the first circulation passage 2*a* receives an oblique force depicted by arrows S in FIG. 2 from the spiral agitator 12*d* by the rotation thereof. That is, the toner TN receives a component of this oblique force parallel to the axis of the development roller 5 (in the leftward direction as viewed in FIG. 2) and a component of this oblique force perpendicular to the axis of the development roller 5 (in the downward direction as viewed in FIG. 2). As a result, a part of the toner TN is supplied beyond a partition wall 1*d* to the development roller 5, and the remainder not used is fed leftward as shown by arrows T1 in FIG. 2.

Figure 9:
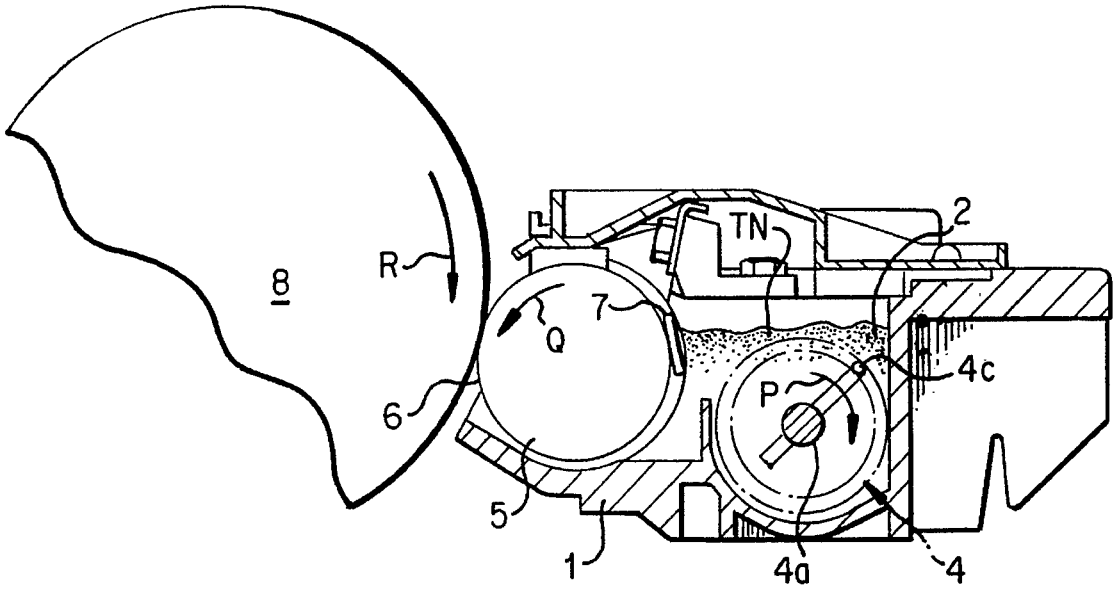
FIG. 9 is a schematic sectional view of an electrophotographic single-component developing device in the prior art.

Then, as similar to the prior art single-component developing device shown in FIG. 9, the rising amount (height) of a magnetic brush of the toner TN supplied to the development roller 5 is restricted by a blade 7 to form a uniform thin layer of the toner TN on a development sleeve 6 rotating in a direction depicted by an arrow Q in FIG. 1. Then, the toner TN on the development sleeve 6 is transferred to a photosensitive drum 8 rotating in a direction depicted by an arrow R, thereby developing a latent image formed on the photosensitive drum 8. On the other hand, the toner TN fed leftward as shown by the arrows T1 in the first circulation passage 2*a* reaches the left end of the first circulation passage 2*a* terminating at the left side wall 1*b* of the housing 1. Then, the toner TN passes through the left opening 10 as shown by an arrow T2 in FIG. 2 to reach the left end of the second circulation passage 2*b* initiating at the left side wall 1*b* of the housing 1.

The toner TN fed to the left end of the second circulation passage 2*b* is further fed rightward as shown by arrows T3 in FIG. 2 in the second circulation passage 2*b* by the rotation of the spiral agitator 13*c* of the second feeding means 13 in a direction depicted by an arrow P2 in FIG. 1. When the toner TN reaches the right end of the second circulation passage 2*b* terminating at the right side wall 1*c* of the housing 1, the toner TN passes through the right opening 11 as shown by arrows T4 in FIG. 2 to reach the right end of the first circulation passage 2*a* initiating at the outlet of the toner supply passage 3. Then, the toner TN is fed again leftward as shown by the arrows T1 in the first circulation passage 2*a* by the rotation of the spiral agitator 12*d*, and a part of the toner TN is supplied to the development roller 5, while the remainder is fed leftward. In this way, the toner TN in the toner storing portion 2 is circulated as shown by the arrows T1 to T4 in the circuit consisting of the first circulation passage 2*a*, the left opening 10, the second circulation passage 2*b* and the right opening 11. Accordingly, the deterioration of the unused toner TN in the toner storing portion 2 due to hardening is prevented to maintain a good condition of the toner TN.

In the electrophotographic single-component developing device according to the first preferred embodiment mentioned above, the ability of toner feed in the direction along the first circulation passage 2*a*, i.e., in the direction parallel to the development roller 5 can be improved by the spiral agitator 12*d* in the first circulation passage 2*a*. Furthermore, since the spiral agitator 12*d* has a low agitation ability, the toner TN is slightly agitated while being fed, and the deterioration of the toner TN due to agitation can therefore be prevented. Accordingly, even when an image having a high image density is continuously developed, the problem of insufficient development of the image due to the deficiency of the ability of toner feed in the direction parallel to the development roller 5 can be eliminated, and the deterioration of the toner TN due to the agitation during feeding can be prevented to thereby obtain a high-quality image.

A second preferred embodiment of the present invention will now be described with reference to FIGS. 4 to 6, in which the same reference numerals as those shown in FIGS. 1 to 3 denote the same parts, and the detailed explanation thereof will be omitted herein.

Figure 4:
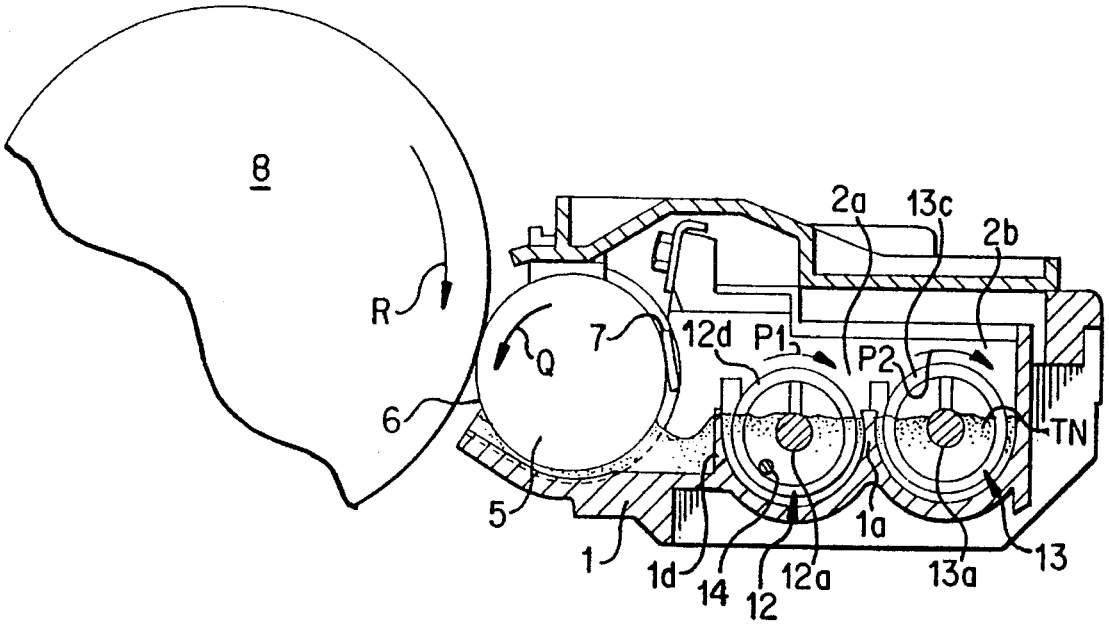
FIG. 4 is a view similar to FIG. 1, showing a second preferred embodiment of the present invention.
Figure 5:
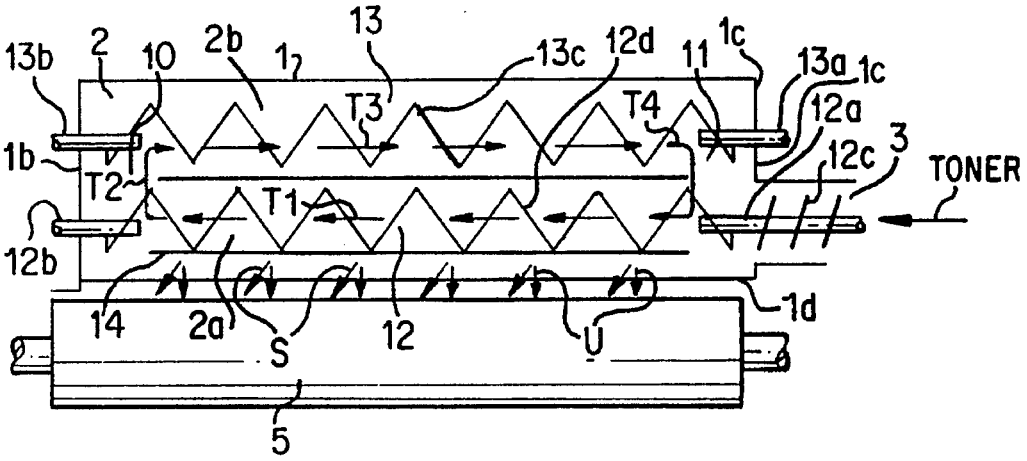
FIG. 5 is a view similar to FIG. 2, showing the second preferred embodiment.
Figure 6:
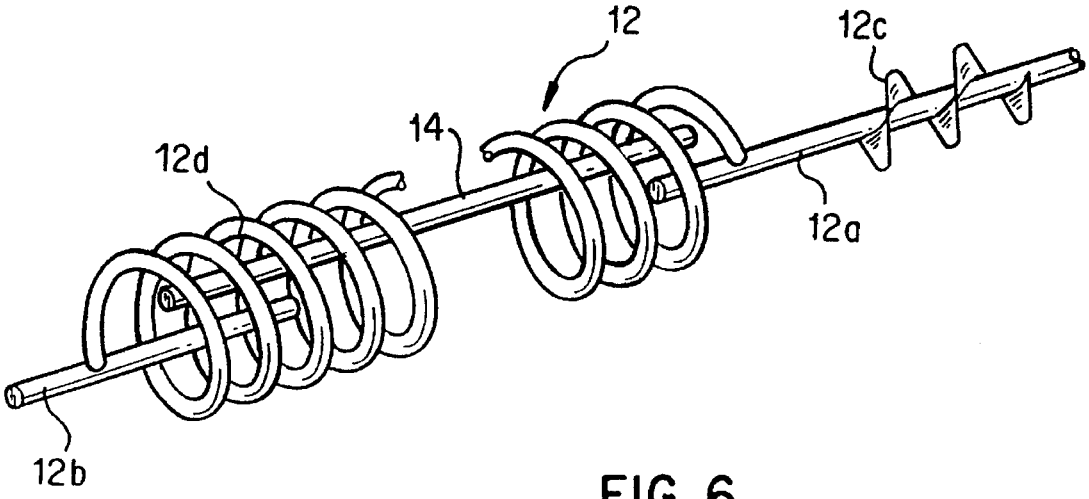
FIG. 6 is a view similar to FIG. 3, showing toner feeding means employed in the second preferred embodiment.

As apparent from FIGS. 4 to 6, the second preferred embodiment is similar to the first preferred embodiment except that an accelerator rod 14 formed from a stainless steel wire or the like is added to the spiral agitator 12*d* located in the first circulation passage 2*a* according to the second preferred embodiment. More specifically, referring to FIG. 6, the accelerator rod 14 is mounted on the inner circumference of the spiral agitator 12*d* so as to extend in parallel to the right and left rotating shafts 12*a* and 12*b*. Alternatively, the accelerator rod 14 may be arranged at an inclined angle of 45 degrees or less with respect to the right and left rotating shafts 12*a* and 12*b*.

As shown in FIG. 5, the accelerator rod 14 functions to apply a force perpendicular to the partition wall 1*d* as shown by arrows U to the toner TN in the first circulation passage 2*d*. Accordingly, the toner TN in the first circulation passage 2*a* receives this force generated by the accelerator rod 14 in addition to the component of the oblique force shown by arrows S in the direction perpendicular to the partition wall 1*d*, i.e., the axis of the development roller 5. As a result, the amount of toner supplied to the development roller 5 beyond the partition wall 1*d* is increased by the accelerator rod 14.

Accordingly, even when an image having a high image density is continuously developed, a sufficient amount of the toner TN to be supplied to the development roller 5 beyond the partition wall 1*d* in comparison with a consumption of the toner TN to be supplied from the development roller 5 to the photosensitive drum 8 can be ensured to thereby reliably prevent the insufficient development of the image due to the deficiency of the toner supply amount to the development roller 5.

The toner supply amounts to the development roller 5 in the first preferred embodiment employing the spiral agitator 12*d* only and the second preferred embodiment employing the spiral agitator 12*d* with the accelerator rod 14 were actually tested in an ordinary environment and a hot, humid environment where the fluidity of the toner becomes low. The test results are shown in FIGS. 7A and 7B, wherein the proportion of the toner supply amount in the second preferred embodiment is shown on the basis of the toner supply amount in the first preferred embodiment which is reduced to 100%.

Figure 7A:
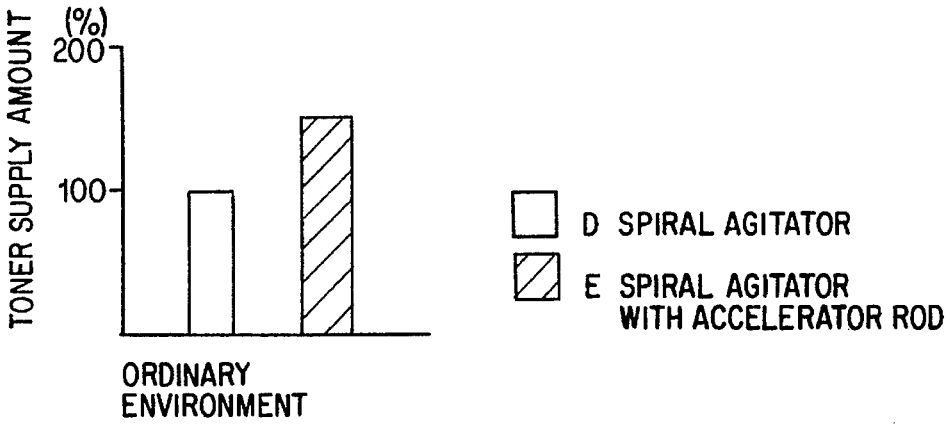
FIGS. 7A and 7B are graphs illustrating the test results of a toner supply amount in the ordinary environment and the hot, humid environment, respectively, according to the first and second preferred embodiments.

As apparent from FIG. 7A, the toner supply amount in the second preferred embodiment in the ordinary environment is about 150% in comparison with 100% of the toner supply amount in the first preferred embodiment. Further, as apparent from FIG. 7B, the toner supply amount in the second preferred embodiment in the hot, humid environment is about 130% in comparison with 100% of the toner supply amount in the first preferred embodiment.

Figure 7B:
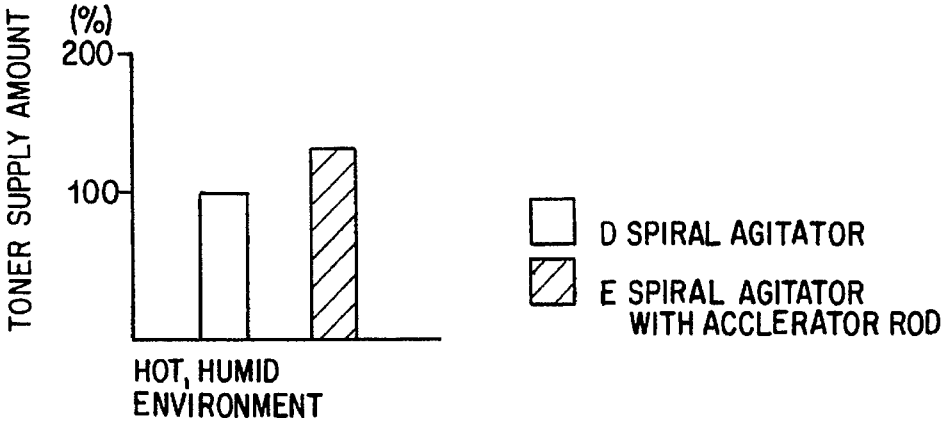

It is understood from the above test results shown in FIGS. 7A and 7B that the ability of the toner supply in the second preferred embodiment employing the spiral agitator 12*d* with the accelerator rod 14 is greater than that in the first preferred embodiment employing the spiral agitator 12*d* only in both the ordinary environment and the hot, humid environment.

Figure 10:
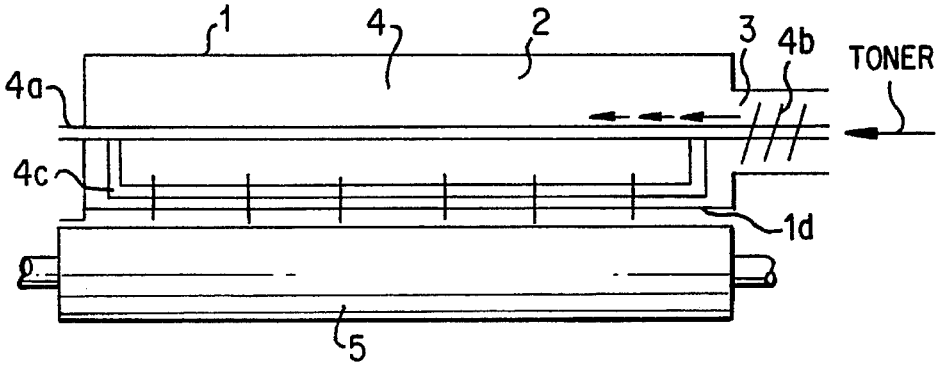
FIG. 10 is a schematic plan view of FIG. 9.
Figure 11:
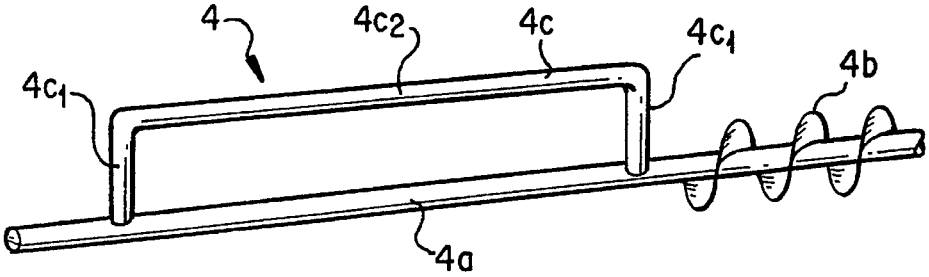
FIG. 11 is a perspective view of toner feeding means employed in the prior art developing device.

Further, running tests of high image density print in the hot, humid environment were actually carried out by using the developing device of the first preferred embodiment employing the spiral agitator 12 only, the developing device of the second preferred embodiment employing the spiral agitator 12*d* with the accelerator rod 14, and the prior art developing device shown in FIGS. 9 to 11 employing the agitator rod 4*c* as a straight rod parallel to the axis of the development roller 5. The test results are shown in Table 1.

TABLE 1

Running tests of high image density in the hot, humid environment

| Test No. | Results |
|---|---|
| 1 | No problem after 60000 prints |
| 2 | No problem after 30000 prints |
| 3 | Lack of image after 20000 prints |
| 4 | Lack of image after 1500 prints |

Note:
(1) In Test Nos. 1 and 2, the developing device of the second preferred embodiment is used.
(2) In Test No. 3, the developing device of the first preferred embodiment is used.
(3) In Test No. 4, the developing device in the prior art is used.

As apparent from Table 1, the developing device of the second preferred embodiment used in Test No. 1 has no problem even after 60000 prints, that is, no insufficient development of the image occurs so that continuous prints of an image having a high image density in the hot, humid environment occur.

Similarly, the developing device of the second preferred embodiment used in Test No. 2 has no problem even after 30000 prints, that is, no insufficient development of the image occurs.

To the contrary, the developing device of the first preferred embodiment used in Test No. 3 does not generate insufficient development of the image until 20000 prints have been generated. Accordingly, if the number of prints is limited, no problem will occur in performing continuous prints of an image having a high image density in the hot, humid environment.

Further, the developing device in the prior art used in Test No. 4 causes the insufficient development of the image even after 1500 prints. Accordingly, the prior art developing device has a problem in performing continuous prints of an image having a high image density not only in the hot, humid environment but also in the ordinary environment.

Figure 8:
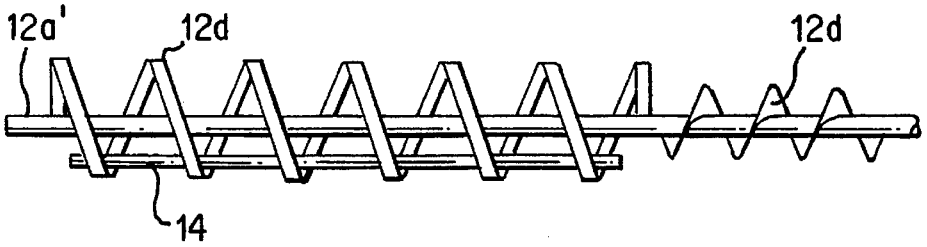
FIG. 8 is an elevational view of a modification of the toner feeding means.

While the spiral agitator 12 shown in FIG. 6 has the right and left rotating shafts 12*a* and 12*b* separated from each other, it may have a single rotating shaft 12*a*' as shown in FIG. 8. Similarly, the spiral agitator 12 shown in FIG. 3 may have the single rotating shaft 12*a*' instead of the right and left rotating shafts 12*a* and 12*b*.

Although the above preferred embodiments of the present invention is applied to an electrophotographic single-component developing device using a magnetic toner as a single-component developer, the present invention may be applied to an electrophotographic single-component developing device using a nonmagnetic toner as a single-component developer.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. An electrophotographic single-component developing device comprising:

a development roller;

toner storing means provided in parallel relationship to an axis of said development roller, for storing a single-component toner; and toner feeding means provided in said toner storing means, for feeding said single-component toner stored in said toner storing means in a direction parallel to said axis of said development roller and supplying said single-component toner to said development roller, said toner feeding means comprising a spiral agitator housing spirals formed from a wire and an accelerator rod mounted on said spirals of said spiral agitator.

2. The electrophotographic single-component developing device as defined in claim 1, wherein said accelerator rod mounted on said spiral agitator extends at an inclined angle of not greater than 45 degrees with respect to said axis of said development roller.

3. The electrophotographic single-component developing device as defined in claim 1, wherein said toner feeding means further comprises a pair of coaxial rotating shafts separated from each other so as to extend in parallel to said axis of said development roller, said spiral agitator having one end connected to one of said rotating shafts and the other end connected to the other rotating shaft.

4. The electrophotographic single-component developing device as defined in claim 1, wherein said toner feeding means further comprises a single rotating shaft extending in parallel to said axis of said development roller, said spiral agitator having opposite ends connected to said single rotating shaft.

5. An electrophotographic single-component developing device comprising:

a development roller;

a first circulation passage juxtaposed to said development roller so as to extend in parallel to an axis of said development roller;

a second circulation passage juxtaposed and extending parallel to said first circulation passage, said first circulation passage and said second circulation passage storing a single-component toner and communicating with each other at both opposite ends of said first circulation passage and said second circulation passage to define a recirculating path;

a first spiral agitator formed from a wire, said first spiral agitator disposed in said first circulation passage;

an accelerator rod mounted on said first spiral agitator;

a second spiral agitator formed from a wire, said second spiral agitator disposed in said second circulation passage wherein said toner is circulated by said first spiral agitator and said second spiral agitator along said recirculating path and said toner is supplied to said development roller by said accelerator rod.

6. The electrophotographic single-component developing device as defined in claim 5, wherein said accelerator rod is mounted on said first spiral agitator so as to extend in parallel to said axis of said development roller.

7. The electrophotographic single-component developing device as defined in claim 6, wherein said accelerator rod mounted on said first spiral agitator extends at an inclined angle of not greater than 45 degrees with respect to said axis of said development roller.

8. The electrophotographic single-component developing device of claim 5, wherein said first spiral agitator and said second spiral agitator are each connected to one of a pair of rotating shafts extending in parallel to said axis of said development roller.

9. An electrophotographic single-component developing device comprising:

a development roller;

a first circulation passage juxtaposed to said development roller so as to extend in parallel to an axis of said development roller;

a second circulation passage juxtaposed and extending parallel to said first circulation passage, said first circulation passage and said second circulation passage storing a single-component toner and communicating with each other at both opposite ends of the first circulation passage and the second circulation passage to define a recirculating path;

a first spiral agitator formed from a wire, said first spiral agitator disposed in said first circulation passage;

a second spiral agitator formed from a wire, said second spiral agitator disposed in said second circulation passage wherein said toner is circulated by said first spiral agitator and said second spiral agitator along said recirculating path and supplied to said development roller, wherein said first spiral agitator is directly connected at opposite ends thereof to a first pair of coaxial rotating shafts and said second spiral agitator is directly connected at opposite ends thereof to a second pair of coaxial rotating shafts, said first and second pairs of rotating shafts extending parallel to said axis of said development roller.

* * * * *